United States Patent [19]

Genovese

[11] 4,418,854

[45] Dec. 6, 1983

[54] BACKPACK SHELTER APPARATUS

[76] Inventor: Joseph Genovese, 156 West Ivanhoe, Chandler, Ariz.

[21] Appl. No.: 325,091

[22] Filed: Nov. 25, 1981

[51] Int. Cl.[3] ..... A45F 4/04

[52] U.S. Cl. ..... 224/154

[58] Field of Search ..... 224/154, 155, 156

[56] References Cited

U.S. PATENT DOCUMENTS

| | | | |
|---|---|---|---|
| 3,822,813 | 7/1974 | Carter | 224/154 |
| 3,912,138 | 10/1975 | Dava | 224/154 |
| 3,923,217 | 12/1975 | Dean et al. | 224/154 |
| 3,931,918 | 1/1976 | Smith et al. | 224/154 |
| 3,971,495 | 7/1976 | Velazquez | 224/154 |
| 4,251,015 | 2/1981 | Gale, Jr. | 224/154 |

*Primary Examiner*—Steven M. Pollard

*Attorney, Agent, or Firm*—Harry M. Weiss; Charles P. Padgett, Jr.

[57] ABSTRACT

A backpack shelter apparatus which incorporates a backpack, frame means, shelter and shelter support means adjustably coupled to the frame means. The shelter support means can be extended from the frame means to provide support for the shelter, backpack, and frame means. The shelter unfolds from the frame means and is erected to provide an enclosure wherein the backpack is in an upright position and a person can be protected from the elements.

9 Claims, 9 Drawing Figures

FIG. 1
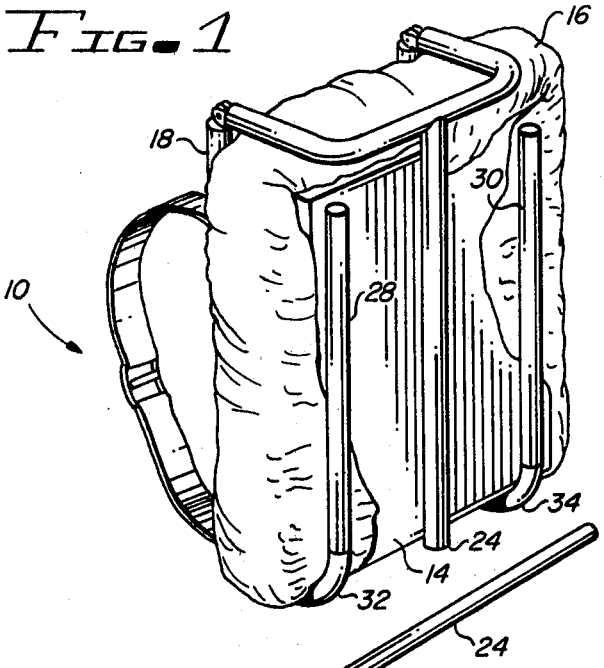
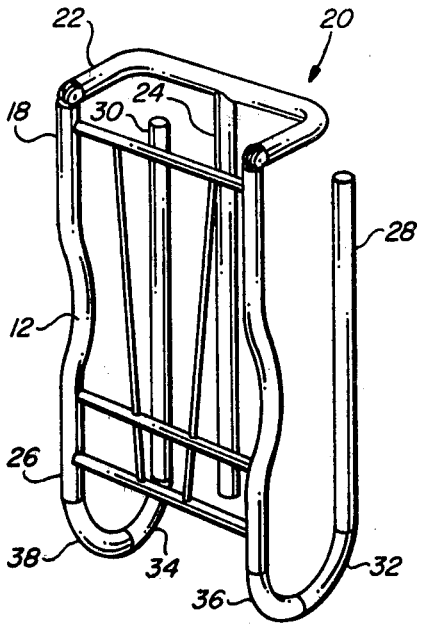
FIG. 2
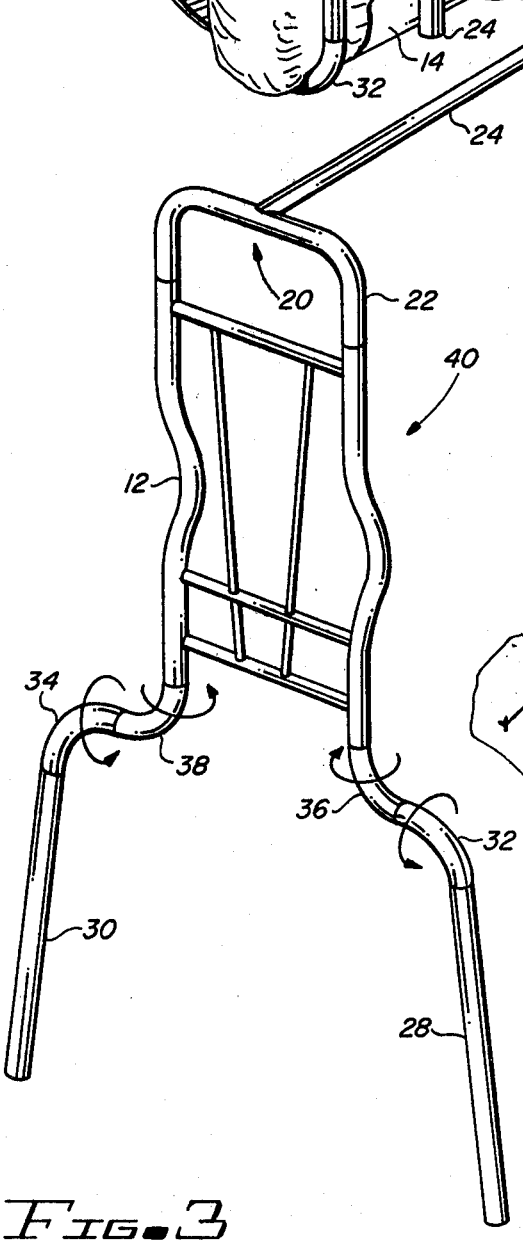
FIG. 3
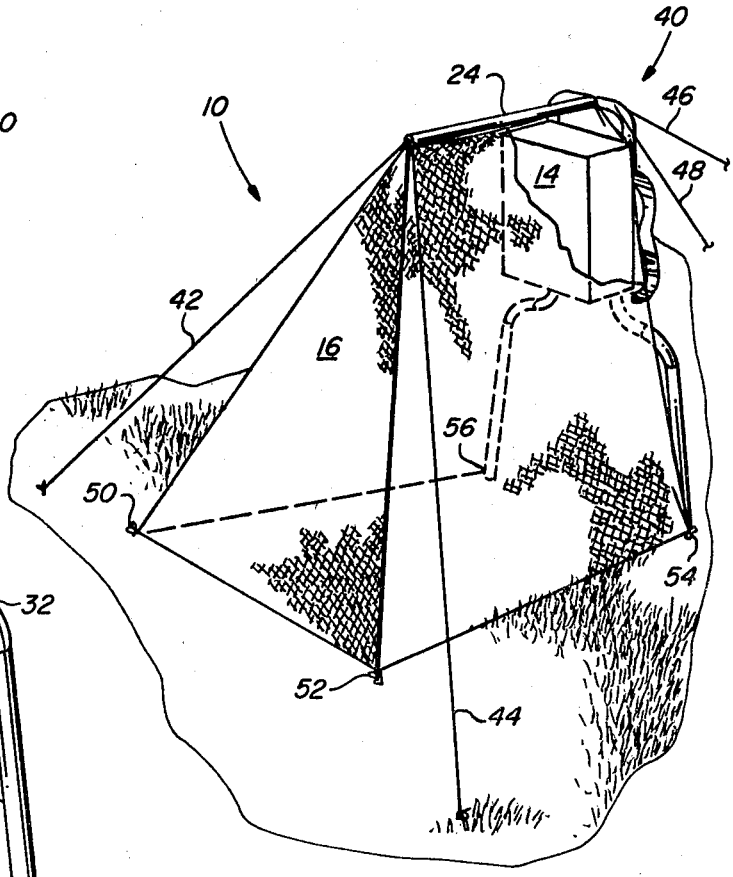
FIG. 4

BACKPACK SHELTER APPARATUS

BACKGROUND OF THE INVENTION

1. Field of the Invention

This invention relates generally to camping equipment, and more specifically, to a backpack shelter apparatus which includes a backpack, backpack frame, an integrally attached foldable shelter, and a compactable shelter support frame which is coupled to the backpack frame.

2. Description of the Prior Art

In the past, backpacks and backpack frames were fabricated for maximum efficiency. They often included light weight frames and strong packs which could hold relatively large quantities of camping gear. In addition, there was usually provided an area on the backpack frame where a compact tent and tent frame could be carried.

Whereas this type of prior art was efficient in storing the camping gear, there were numerous inconveniences inherent in its design. Primarily, the area allotted on the backpack frame to carry the tent was necessarily limited. As a result, the size of the tent was restricted to being small and lightweight, having a minimum number of tent frame members. Therefore, the tents were rarely large enough to hold more than one person comfortably. Moreover, the backpack could not be secured in an upright position within the tent. In addition, it was further required that the inhabitant of the tent remain in a sitting or prostrate position, as the tent and tent frame were not large enough to permit standing.

The need existed to design a backpack and backpack frame which included a means for attaching a relatively large and lightweight shelter and shelter frame that could be easily erected, providing an efficient, comfortable, convenient and mobile backpack shelter apparatus.

SUMMARY OF THE INVENTION

It is an object of this invention to provide an improved backpack shelter apparatus.

It is another object of the improved backpack shelter apparatus to provide an efficient means for carrying relatively large quantities of camping gear and a comfortable, convenient shelter and shelter support frame.

It is another object of the improved backpack shelter apparatus to provide a shelter support frame that is integrated into the backpack frame, and easily unfolds therefrom.

It is another object of the improved backpack shelter apparatus to provide a shelter that unfolds easily onto the shelter support frame and is large enough to allow the inhabitant to stand and to conveniently allow the backpack to remain within the tent enclosure.

It is a final object of the improved backpack shelter apparatus to provide for the adaptation of the frame so as to be incorporated for use on mobile vehicles such as motorcycles.

The above and other objects are included in a backpack shelter apparatus comprising, in combination, a back pack, frame means, shelter means, and shelter support means adjustably connected to the frame means. The shelter support means includes an upper arm member hingedly fastened to a top portion of the frame means, and at least two lower leg members rotatably coupled to a lower portion of the frame means. The upper arm member extends from a folded position to a near horizontal shelter support position, and the lower leg members rotate from a near vertical upward position to a distended support position. The shelter means, which is either integrally or removably fastened to the frame means, unfolds from the frame means and is supported at a top portion by the horizontally extended upper arm member. The frame means and attached backpack are elevated from the ground and supported by the distended lower leg support member. The backpack is enclosed by the shelter means and, thus, protected from natural elements and is within convenient proximity to the shelter inhabitant.

The foregoing and other objects, features and advantages will be apparent from the following, more particular, description of the preferred embodiments of the invention, as illustrated in the accompanying drawings.

BRIEF DESCRIPTION OF THE DRAWING

FIG. 1 is a perspective view of a backpack shelter apparatus with a folded shelter means with a portion broken away, and compacted shelter support means.

FIG. 2 is a perspective view of the frame means and compacted shelter support means with the backpack and shelter means removed.

FIG. 3 is a elevational view of the frame means and shelter support means of FIG. 2 in an erected position.

FIG. 4 is a plan view of the erected backpack shelter apparatus of FIG. 1 with part removed to reveal the inside compartment of the shelter means.

Referring to FIGS. 1 and 2, a backpack shelter apparatus is referenced generally by the numeral 10. Attached to a frame means 12 is a backpack 14 and a shelter means 16. Hingedly attached to the frame means 12 at its top 18 is an upper arm member 20. The upper arm member 20 is comprised of arch shaped hinging bar 22 and a horizontal support arm 24. Rotatably coupled to the frame means 12 at a lower portion 26 are two lower leg members 28 and 30. Multiple hinges 32, 34, 36 and 38 facilitate the erection of a shelter support means as described in a following paragraph. As shown, the shelter means 16 is folded and stored around the backpack 14, upper arm member 20 is hinged over the shelter means 16 and backpack 14, and the two lower leg members 28 and 30 are rotated parallel to the horizontal support arm 24.

Referring to FIG. 3, the frame means 12 is shown with a shelter support means, referenced generally by the numeral 40, erected in a manner so as to provide a supporting frame for the shelter means 16 of FIG. 1. The lower support legs 28 and 30 are rotated to the support position shown by pivoting double rotating elbow means hinges 32 and 34 downwards, and hinges 36 and 38 outwards as shown by the arrows. The hinges 32, 34, 36 and 38 can be locked in position by any conventional method to prevent collapse of the shelter support means 40. Upper arm member 20 is shown hinged and similarly locked in a shelter means support position. Horizontal support arm 24 forms a cantilever that extends parallel to the ground, and provides support at the apex of the unfolded shelter means 16 (see FIG. 4).

Referring to FIG. 4, the shelter means 16 is unfolded, with part cut away, and is supported by the shelter support means 40. As shown, the shelter means 16 unfolds from around the backpack 14, and when completely erected, conveniently encloses the backpack 14 so that it is protected from the elements and also within convenient reach of an inhabitant of the backpack shelter apparatus 10. To provide further support, tie downs 42 and 44 are connected to one end of the horizontal support arm 24 and distended as shown. Tie downs 46 and 48 are connected at the opposite end on the arch shaped hinging bar 22 and similarly distended. To assure that the shelter means 16 retains its erected shape, it is pulled taught and tied down at corners 50, 52, 54 and 56.

Referring to FIG. 5, a second embodiment of a backpack shelter apparatus is referenced generally by the numeral 58 and is adapted to be coupled to the back of motorcycle 60. Elements similar to those of FIGS. 1 through 4 are numbered correspondingly. Shelter means 16 folds completely above backpack 14. Lower leg members 28 and 30, unlike those of FIGS. 1 through 4, are hingedly fastened to the lower part 26 of frame means 12 by hinges 62 and 64, respectively. When not in a lowered shelter support position, the lower leg members 28 and 30 are held in an upright position by clamps 66 and 68, respectively, (see FIG. 8) which are fastened to members 70 and 72, respectively, of the frame means 12.

In FIG. 6, the backpack shelter apparatus 10 is shown with the shelter means 16 unfolded and supported by the shelter support means 40. As above, the shelter means 16 is firmly supported at the horizontal support arm 24 and the arch shaped hinging bar 22 by the tie downs 42, 44, 46 and 48. Also shelter means 16 is held at its corners 50, 52, 54 and 56. Lower leg supports 28 and 30 not only provide support for the backpack shelter apparatus 58, but additionally, retain the motorcycle 60 in as near a vertical position as possible.

Referring to FIG. 7, one method of hinging the upper arm member 20 is shown by example only and referenced generally by the numeral 74. A first flange 76 is permanently coupled within the hinging bar 22 and is hingedly coupled to a second flange 78 by pin 80. The second flange 78 is slidably coupled within the top portion of the backpack frame 18.

Referring to FIG. 7A, the hinging mechanism of FIG. 7 is shown in a locked, upright position. When the hinging bar 22 is raised to a vertical position, the second flange 76 retracts inside the top portion of backpack frame 18 over the pin 80. In this manner, the hinging bar 22 is prevented from pivoting around the pin 80, providing secure support for the horizontal support arm 24 and shelter means 16.

Figure 5:
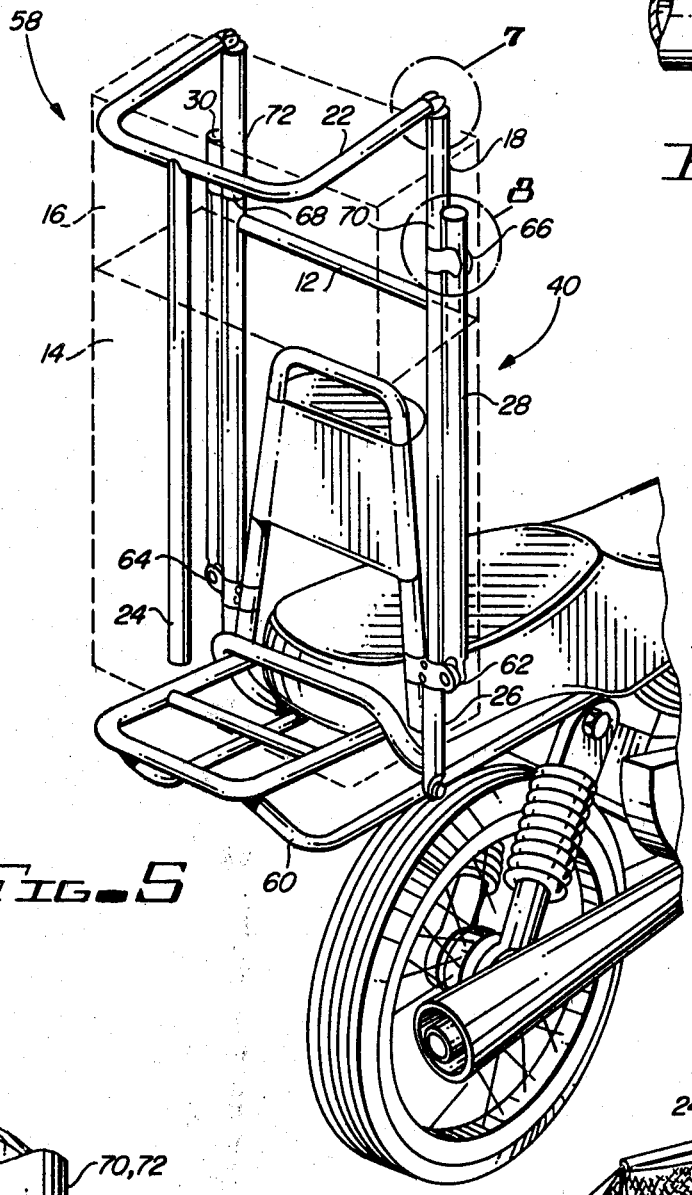
FIG. 5 is a perspective view of a second embodiment of the backpack shelter apparatus adapted to be coupled to a mobile vehicle.
Figure 7:
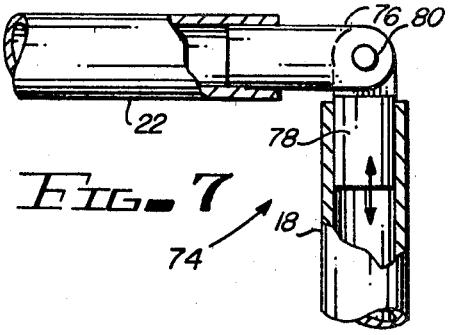
FIG. 7 is a side elevational view of a hinging and locking method, in a hinged position, with parts cut away to reveal its elements.
Figure 7A:
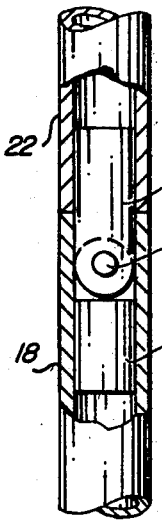
FIG. 7A is a side elevational view of a hinging and locking method, in a locked position, with parts cut away to reveal its elements.
Figure 8:
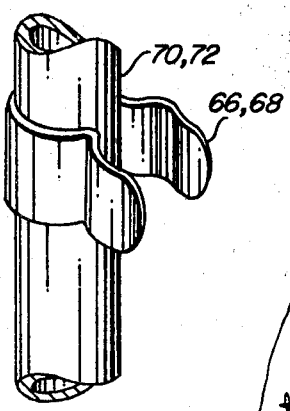
FIG. 8 is a side elevational view of a clamping method used to retain members of the shelter support means.
Figure 6:
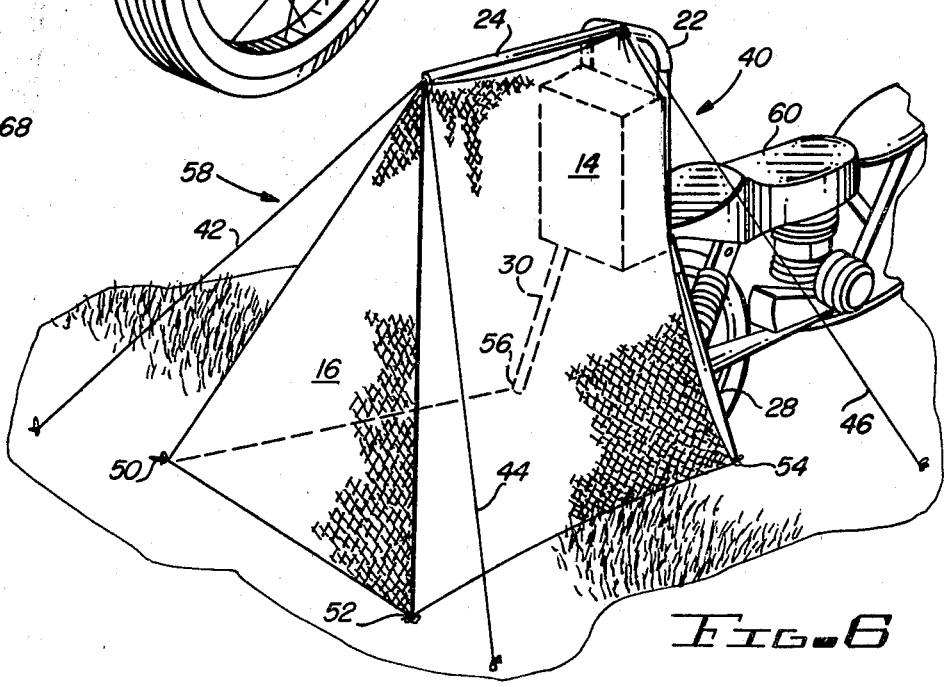
FIG. 6 is a plan view of an erected backpack shelter apparatus shown in FIG. 5.

While the invention has been particularly shown and described with reference to preferred embodiments thereof, it will be understood by those skilled in the art that the foregoing and other changes in form and details may be made therein without departing from the spirit and scope of the invention. For example, hinges 32, 34, 36 and 38 in FIGS. 1, 2 and 3 could be replaced by hinges 62 and 64 of FIG. 5, thereby hingedly coupling lower leg members 28 and 30, respectively, to the lower part 26 of the frame means 12.

What is claimed is:

1. A backpack shelter apparatus, comprising:

foldable shelter means adapted for folding into said backpack for storage;

a frame having a pair of legs and member means that are foldable about said shelter means when in the folded position for permitting said backpack, frame and shelter means to be mounted on the back of a person and for forming a cantilever with said shelter means adapted for placement over said frame and said cantilever to form an enclosure wherein said backpack remains connected to said frame;

said pair of legs each including double elbow means operably disposed proximate the midsection of said legs, said double elbow means being operatively rotatable in any rotational direction for forming said pair of legs into a collapsed U-shaped configuration adapted for retainably receiving said folded shelter means therein and said member means being hingedly secured to said pair of legs for closing over the top of said folded shelter means and for extending downwardly between the ends of said legs and substantially parallel thereto for removeably retaining said folded shelter means in a portable backpack configuration, said double elbow means being further operative for rotating said pair of legs for forming a pair of elongated extended S-shaped members and said member means folding upward such that said cantilever formed by said member means extends substantially horizontally outward from the plane of the upper portion of said pair of legs and is substantially perpendicular to said plane, said cantilever means and said legs forming a frame over which said unfolded shelter means is supported for forming a tent-like shelter or the like; and means for fixedly locating the lower distal end of said pair of legs when in said elongated, extended, S-shaped configuration, on the ground.

2. A backpack shelter apparatus as defined in claim 1 wherein said backpack is integrally connected to said frame.

3. A backpack shelter apparatus as defined in claim 1 wherein said shelter is integrally connected to said frame.

4. A backpack shelter apparatus as defined in claim 1 wherein said shelter is removably attached to said frame.

5. The backpack shelter apparatus of claim 1 wherein said member means includes a cantilever having an elongated upper arm member hingedly attached to the distal end of said legs by a relatively wide, inverted, U-shaped member, said member means further including hinge-like means mounted proximate the distal end of said legs and proximate the distal end of said inverted U-shaped member for hingedly coupling said legs and said U-shaped members and wherein said inverted U-shaped member further includes means for rigidly securing said elongated upper arm member to a central portion of said inverted U-shaped member, said upper arm member extending substantially perpendicular to the plane of said U-shaped member for forming said cantilever when said hinge-like means align the ends of said U-shaped member with the upper ends of said pair of legs for operably disposing said elongated upper arm member downwardly between said pair of legs and substantially parallel thereto when said hinge-like means is opened to form approximately a 90 degree angle between the upper end portion of said pair of legs and the arms of said U-shaped member for enclosing the top and one side of said folded shelter means therebetween.

6. The backpack shelter apparatus of claim 1 wherein said pair of legs each have an upper member and a lower member rotatable relative to each other, said midportion between said lower member and said upper member including said double elbow means for enabling said rotation, said double elbow means comprising a pair of tubular elbow sections, the first elbow section having one end rotatably attached to the upper member for rotation thereabout, a second tubular elbow member having one end rotatably attached to the opposite end of said first tubular elbow section for rotational movement thereabout, and the opposite end of said second tubular elbow section being operably secured to the upper end of said lower member thereby enabling said pair of legs to be rotated to either said collapsed U-shaped configuration for retainably holding the folded shelter or to the extended S-configuration for providing a stand-up frame for said cantilever.

7. The backpack shelter apparatus of claim 1 wherein said backpack is in an upright position within the enclosure formed from the upper member portion of said pair of legs forming one side of said backpack frame, the collapsed U-shape configuration forming the bottom side of the backpack frame, the upwardly extending lower member portion of said pair of legs forming the edge supporting on the opposite side of the backpack, said inverted U-shaped member forming the top of the backpack frame and said upper arm member forming a central frame portion on said opposite side of said backpack frame.

8. A backpack shelter apparatus comprising:

foldable shelter means for being carried on said backpack when folded and for forming a shelter when unfolded;

a dual purpose frame comprising a pair of leg means each of which includes an upper leg member and lower leg member, each of said leg means further including a double elbow means operably disposed intermediate said upper and lower leg members for rotatably coupling said upper and lower leg members, said frame further including a generally spread, inverted, U-shaped support means having its opposite ends hingedly coupled to the distal ends of said upper leg members and an elongated support bar means having one end integrally coupled proximate the center of said spread U-shaped support means and extending substantially perpendicular to the plane thereof;

said double elbow means being rotatable for forming a collapsed U-shaped structure wherein the top leg members are substantially parallel to and disposed opposite from said bottom leg members and spacially separated therefrom a distance sufficient to receive and retainably hold said folded shelter means therebetween, said collapsed U-shaped structure being hinged approximately 90° down from its upright position for closing to form a top for securing said folded shelter means thereunder and for pivoting said elongated support bar so that it is disposed approximately between said pair of lower leg members and is substantially parallel thereto for completing the backpack frame configuration for removeably retaining said folded shelter means within said collapsed U-shaped structure; and said double elbow coupling means being further rotatable for forming an extended S-shaped structure wherein the top leg members are substantially parallel to one another an in approximately the same plane as said lower leg members, said double elbow coupling means rotating to displace the lower leg members to provide a wider base for the generally upright frame comprising the upper leg members, the double elbow coupling means and the lower leg members for greater stability and the like, said spread U-shaped support means being hinged so as to be substantially coaxial with the upper end portions of said upper leg members for operatively disposing said elongated support bar generally horizontally outward from the plane of said frame and approximately perpendicular thereto for forming a cantilever over which said unfolded shelter means can be placed for forming a shelter means.

9. A backpack shelter apparatus comprising:

a foldable shelter means adapted to be folded up for storage purposes on a backpack or the like and unfolded for forming a shelter means;

a frame comprising a pair of leg means, each of said leg means including an upper leg portion, a lower leg portion, and a pair of rotatable double elbow means operatively coupling said top and bottom leg portions, a support member and means for hingedly securing said support member to the distal ends of said top leg portions, said bottom leg portions being responsive to the rotation of said double elbow means for forming a collapsed U-shaped frame for retainably receiving said folded shelter means therein, said support member being hinged at the top distal ends of said upper leg portion with the lower distal ends of said upper leg portions being operatively coupled to said double elbow coupling means and being rotatable with respect thereto for forming an extended S-shaped leg structure with the lower distal end of the lower leg members for fixedly disposing the lower distal leg ends on the ground or the like and whenever said hinged support means is turned upright so as to be coaxial with the upper leg means, said upper and lower leg means and said hinged support means forming an upright support frame, said upper support member operatively positioning said elongated support member substantially horizontally outward therefrom for forming a cantilever, said unfolded shelter means being adaptable for cooperatively engaging said cantilever and said upright support frame for forming said shelter means.

* * * * *